United States Patent [19]

Flaum

[11] 4,326,309

[45] Apr. 27, 1982

[54] BEDDING DEVICE

[76] Inventor: Dennis M. Flaum, 260 E. Chestnut, Chicago, Ill. 60610

[21] Appl. No.: 156,265

[22] Filed: Jun. 3, 1980

[51] Int. Cl.[3] ..... A47C 17/04; A47C 13/00

[52] U.S. Cl. ..... 5/12 R; 5/465; 297/440

[58] Field of Search ..... 5/12 R, 51 B, 465, 437, 5/440; 297/118; D6/61, 201

[56] References Cited

U.S. PATENT DOCUMENTS

| | | | |
|---|---|---|---|
| 2,543,875 | 3/1951 | Silverman | 297/440 |
| 3,537,752 | 4/1970 | Kushnarov | 297/456 |
| 3,680,918 | 8/1972 | Briggs | 297/456 |
| 3,742,526 | 7/1973 | Lillard | 5/12 R |
| 3,751,739 | 8/1973 | Assmann | 5/465 |
| 3,829,913 | 10/1974 | Bernard | 5/12 R |
| 3,941,418 | 3/1976 | Bernard | 297/456 |
| 4,032,191 | 6/1977 | Fetsch | 208/440 |
| 4,173,045 | 11/1979 | Osborn | 5/465 |

FOREIGN PATENT DOCUMENTS

| | | | |
|---|---|---|---|
| 2732193 | 12/1978 | Fed. Rep. of Germany | 5/465 |
| 1487312 | 7/1967 | France | 5/12 R |
| 2282247 | 3/1976 | France | 297/440 |

*Primary Examiner*—Alexander Grosz
*Attorney, Agent, or Firm*—Alter and Weiss

[57] ABSTRACT

An article of furniture characterized by use of heavy-weight foam rubber material for the major structural components thereof, combined with a flat base supporting an upstanding tubular frame member. The flat base supports the bottom of the article and the tubular frame member acts as an internally positioned support for the back portion of the article. Seat cushions used with said article are hinged, one to the other and, when folded outward and placed on the floor, form a sleeping surface.

4 Claims, 5 Drawing Figures

BEDDING DEVICE

BACKGROUND OF THE INVENTION

The present invention relates generally to furniture, and more particularly to a couch, love seat, chair, or the like fashioned from resilient foamed material and having a unique inner support frame. Provision is made for a portion of the article of furniture to fold outward and rest on the floor, creating a sleeping surface.

Use of foam rubber in furniture construction has proliferated. Foam rubber is light, easily manufactured and shaped, and has found substantial use in such furniture components as cushions and the like. Once shaped, the foam rubber may be covered with appropriate upholstery material to present any desired outward appearance.

Use of foam rubber as a primary construction material for furniture has heretofore been impracticable. Rigid frames are required to support foam rubber and to keep it in its preselected shape. Attempts made to utilize the outer upholstery to hold the foam rubber in a selected shape have not been entirely successful. Such furniture has been relegated to the status of novelty items rather than as serious, usable furniture.

Articles of furniture that convert to bedding are old and well known, with the "sofa bed" being perhaps the most readily recognizable of such devices. In most such sleepers, an internally positioned folding framework supports a foldable mattress. Converting the article of furniture to a bed requires the removal of any seat, arm, and back cushions, and the pulling outward and upward of the folding internal frame. Commonly the frame must then be folded once more the extend the mattress and support it in a position for sleeping.

Such internal frames are quite complex in construction, with numerous pivots, folding links, and the like. Very often, such frames are difficult and awkward to operate, particularly for those suffering from lower back problems, arthritis, or the like.

Necessarily, the mattresses utilized in such prior art devices are thinner and less supportive than mattresses customarily used on beds. In order for the folding framework to operate, any mattress used must be thin enough to be easily folded. Over time, such mattresses begin to wear at precisely the points at which they are folded.

The cushions normally positioned on the couch must be removed in order to gain access to the folding framework; this creates a problem with storing and placing such cushions out of the way until the article of furniture may be returned to service as a sofa. Strewing such cushions around the room may result in a hazardous situation for a sleeper who awakens in the middle of the night and attempts to cross the floor without adequate lighting.

Inclusion of the internal frame also places restrictions on the styling which may be employed on such articles of furniture. Appearance is enhanced if the frame is completely hidden from view, and appropriate end panels must necessarily be employed to accomplish this result. Such a frame also makes the resulting construction much heavier and more difficult to maneuver.

Accordingly, the present invention has the following objects:

To provide attractive articles of furniture readily convertible for sleeping thereon;

To provide such articles using foam rubber as a primary construction material;

To provide such articles without requiring the use of folding, cumbersome, internal metal frames;

To provide such articles in forms which will create a sleeping surface of greater support and comfort;

To provide such articles in forms which are lightweight and simple to maneuver;

To provide such articles in forms which minimize required removal of cushions or the like in order to convert the article from sitting to sleeping; and To provide such articles in forms which are simple and sturdy to construct and economical to manufacture and maintain.

These and further objects will become more apparent upon consideration of the accompanying drawings wherein.

BRIEF DESCRIPTION OF THE INVENTION

An article of furniture commonly characterized as a sleeper-sofa is constructed of heavy foam rubber material, and has a base segment and a back segment, supporting one or more seat segments.

The base and back segments are fashioned as a single structure and are internally braced and supported by a tubular back brace member attached to a planar bottom support member. Means are provided within the back segment for the insertion therein of the tubular back brace. The planar base support provides a bottom upon which the base portion of the base segment rests.

As least one seat cushion is provided, which is hingedly attached to the base segment at a forward edge thereof to enable the seat cushion to be folded forward to a position in front of the article and to extend along the floor. More cushions may be provided, pivotally attached one to the other such that the base segment and the cushions, when folded forward, create a sleeping surface. The base segment and cushions may be dimensioned to provide a horizontal planar sleeping surface.

DETAILED DESCRIPTION OF THE DRAWINGS

Figure 1:
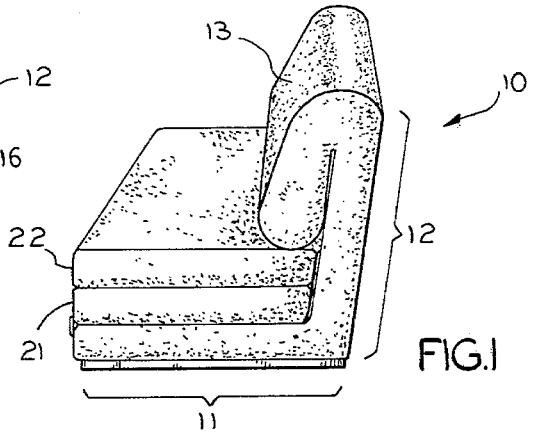
FIG. 1 is a side perspective view of an improved sleeper sofa.

Referring now to FIG. 1, a numeral 10 indicates generally an article of furniture which may be characterized as a sofa. While it should be understood that such articles may be manufactured in sizes more appropriately identified as chairs, love seats, or the like, reference to the article as a sofa will be made herein for purposes of convenience.

Sofa 10 has a base segment 11 and a back segment 12 which, in this particular embodiment, are fashioned as a single construction. In the embodiment illustrated, an integral back cushion 13 is provided.

Figure 3:
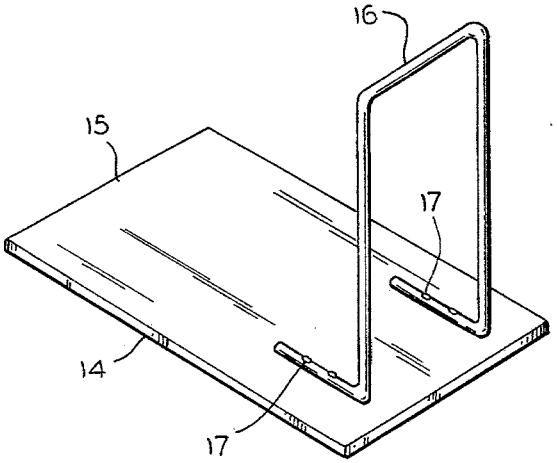
FIG. 3 is a perspective view of the internal frame shown in FIG. 2.

Base segment 11 and back segment 12 are supported and reinforced by frame 14, illustrated in FIG. 3. In the present embodiment, frame 14 includes a planar base 15 and a tubular steel back frame 16.

Back frame 16 is attached to planar base 15 at feet 17. In the present embodiment, feet 17 are integral with back frame 16, and it is contemplated that back frame 16 may be formed as a single, uninterrupted run of tubing. Feet 17 may be fastened to planar base 15 by bolts, rivets, or other suitable and well known fastening devices.

In the present embodiment, it is contemplated that the major components of sofa 10 will be fashioned from shaped heavyweight foam rubber material. Such material has been found in the past to provide comfortable seating and sleeping surfaces, but articles manufactured from said material are not of sufficient rigidity to enable articles of furniture to retain their original shapes.

Figure 2:
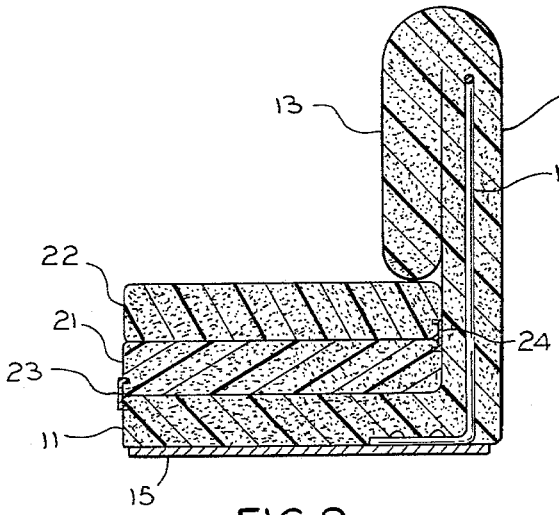
FIG. 2 is a side sectional view of the article illustrated in FIG. 1.
Figure 4:
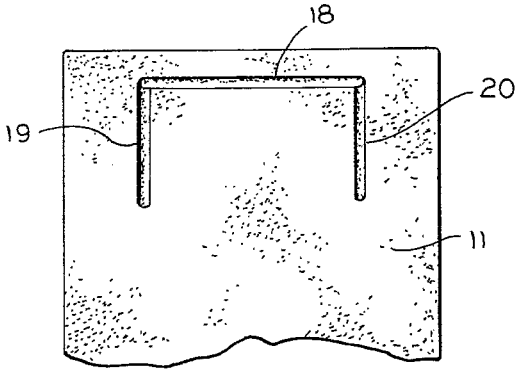
FIG. 4 is bottom view of the base cushion.

As best seen in FIG. 2, frame 14 is positioned such that base segment 11 rests upon planar base 15, while back frame 16 is seated within back segment 12. As best seen in FIG. 4, a slot 18 is fashioned through base segment 11 extending upward into back segment 12 a sufficient distance to accommodate back frame 16. Slots 19 and 20 are fashioned in base 11 to accommodate feet 17 such that base 11 lies flat upon planar base 15.

In the present embodiment, planar base 15 is dimensioned to be co-extensive with back segment 11, and back frame 16 is dimensioned to be substantially co-extensive with back segment 12.

As seen in FIGS. 1 and 2, seat cushions 21 and 22 are provided, with cushion 22 forming a surface upon which one may sit. It is contemplated that such cushions will be manufactured from foam rubber material similar to that used in fashioning segments 11, 12, and 13.

As shown in FIG. 2, cushion 21 and base segment 11 are pivotally attached at 23. Similarly, cushions 21 and 22 are pivotally attached at 24. It is contemplated that such attachment may take the form of a cloth strip extending the length of such cushions, attached to the upholstery material selected to cover the sofa components. It is also contemplated that attaching strips 23 and 24 may be formed from zipper segments, snap segments, or other fasteners commonly used to attach segments of cloth articles to each other, making the cushions separable from each other for purposes of cleaning or replacement.

Figure 5:
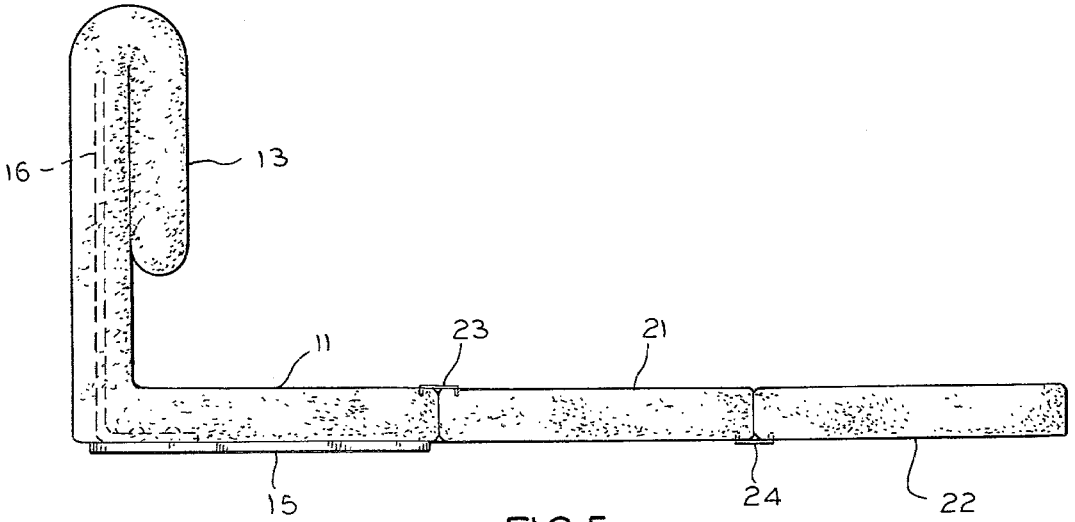
FIG. 5 is a side sectional view illustrating the article opened to a sleeping position.

Use of sofa 10 as a sleeping surface is best illustrated in FIG. 5. Cushion 22 may be grasped and pulled forward thereby drawing cushion 21 outward and away from base segment 11. Attaching strip 24 enables cushion 22 to fold with respect to cushion 21, and attaching strip 23 enables cushion 21 to fold with respect to base segment 11. In this manner, base segment 11, cushion 21, and cushion 22 form a planar sleeping surface, with base 11 supported by planar base 15 and with cushions 21 and 22 resting on the floor.

When an individual is seated on the sofa as illustrated in FIG. 2, it is contemplated that back frame 16 will provide firm yet somewhat resilient support for the back and shoulders of the individual as they rest against back cushion 13.

The foregoing sofa, as previously mentioned, may be manufactured in varying sizes, and it is contemplated that one or more back frames, such as 16, may be employed for longer units.

The individual foam rubber segments of sofa 10 may be upholstered as desired or required, creating a handsome finished appearance.

While the foregoing has presented a specific embodiment of the present invention, such embodiment should be considered as exemplary only. It is expected that others skilled in the art will perceive variations which, while differing from the foregoing, do not depart from the spirit and scope of the invention as herein described and claimed.

I claim:

1. An article of furniture, said article comprising:
- a horizontally extending base member formed from heavy density rubber foam material;
- a substantially vertically extending back member formed from heavy density rubber foam material, said back member formed as a single piece;
- means to support said base member and to internally support said back member,
- said support means including a flat bottom plate shaped and dimensioned to be substantially coextensive with the bottom of said base member,
- said bottom of said base member resting upon said bottom plate;
- said support means further including a tubular member secured to said plate and substantially perpendicular in relationship thereto,
- said tubular member having a central segment with a depending segment at each end thereof,
- each said depending segment terminating in a foot,
- each said foot secured to said plate,
- said back member having a cavity formed therein to allow insertion of said central segment and said depending segments of said tubular member,
- said base member having troughs formed therein to accommodate said feet of said tubular member; and
- at least one seat cushion segment supported by said base member.

2. The article as recited in claim 1 further including means extendable forward of said base member to form a planar area for sleeping, said extendable means including at least said one seat cushion member,
- said seat cushion member being hingedly attached to the front of said base member.

3. The article as recited in claim 2 wherein said extendable means includes a plurality of cushion members,
- the lowermost of said cushion members hingedly attached to the front of said base member,
- each of the remaining of said cushion members hingedly attached to the cushion member immediately subjacent and suprajacent thereto and,
- hinges arranged to enable said cushion members to be drawn forward of said base member to form said planar area for sleeping.

4. The article as recited in claim 1 wherein said back member and said base member are formed as a single member.

* * * * *